US011430408B1

(12) United States Patent
Chaiken et al.

(10) Patent No.: US 11,430,408 B1
(45) Date of Patent: Aug. 30, 2022

(54) DETECTING DISPLAY DEVICE FAILURES USING POWER CONSUMPTION PROFILING

(71) Applicant: Dell Products L.P., Round Rock, TX (US)

(72) Inventors: Craig Lawrence Chaiken, Pflugerville, TX (US); Siva Subramaniam Rajan, Austin, TX (US); Adolfo S. Montero, Pflugerville, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/216,132

(22) Filed: Mar. 29, 2021

(51) Int. Cl.
*G09G 5/10* (2006.01)

(52) U.S. Cl.
CPC ..... *G09G 5/10* (2013.01); *G09G 2310/08* (2013.01); *G09G 2330/021* (2013.01); *G09G 2330/026* (2013.01); *G09G 2330/027* (2013.01); *G09G 2360/141* (2013.01); *G09G 2360/145* (2013.01)

(58) Field of Classification Search
None
See application file for complete search history.

(56) References Cited

U.S. PATENT DOCUMENTS 9,837,006 B2 * 12/2017 Hwang ..... G09G 3/006
2020/0098322 A1 * 3/2020 Park ..... G09G 5/00

* cited by examiner

*Primary Examiner* — Amr A Awad
*Assistant Examiner* — Donna V Bocar
(74) *Attorney, Agent, or Firm* — Baker Botts, L.L.P.

(57) ABSTRACT

Detecting failures using power consumption profiling, including calibrating, at a first time, a system power profile of an information handling system (IHS), including identifying an initial baseline current value of a backlight power of a display device of the IHS; identifying an initial baseline current value of a timing controller of the IHS; calculating, at a second time, an updated system power profile, including: identifying an updated current value of the backlight power of the display device of the IHS; identifying an updated current value of the timing controller of the IHS; determining whether the updated current value of the backlight power of the display device is within a threshold value of the initial baseline current value of the backlight power of the display device.

20 Claims, 7 Drawing Sheets

DETECTING DISPLAY DEVICE FAILURES USING POWER CONSUMPTION PROFILING

BACKGROUND

Field of the Disclosure

The disclosure relates generally to an information handling system, and in particular, detecting display device failures using power consumption profiling at the information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

When an information handling system (e.g., laptop computing device) is returned for repair, when a display of the device is damaged, there is currently no process for determining when the display was damaged—prior to returning the device, or during shipment.

SUMMARY

Innovative aspects of the subject matter described in this specification may be embodied in a method of detecting failures using power consumption profiling, including calibrating, at a first time, a system power profile of an information handling system, including: identifying an initial baseline current value of a backlight power of a display device of the information handling system; identifying an initial baseline current value of a timing controller of the information handling system; calculating, at a second time, an updated system power profile, including: identifying an updated current value of the backlight power of the display device of the information handling system; identifying an updated current value of the timing controller of the information handling system; determining whether the updated current value of the backlight power of the display device is within a threshold value of the initial baseline current value of the backlight power of the display device; in response to determining that the updated current value of the backlight power of the display device is not within the threshold value of the initial baseline current value of the backlight power of the display device, determining whether the updated current value of the timing controller is within a threshold value of the initial baseline current value of the timing controller; and in response to determining that that updated current value of the timing controller is not within the threshold value of the initial baseline current value of the timing controller, updating a state of an indicator to indicate that the timing controller is damaged.

Other embodiments of these aspects include corresponding systems, apparatus, and computer programs, configured to perform the actions of the methods, encoded on computer storage devices.

These and other embodiments may each optionally include one or more of the following features. For instance, in response to determining that the updated current value of the backlight power of the display device is within the threshold value of the initial baseline current value of the backlight power of the display device, updating a state of an additional indicator to indicator that the display device is nominal. In response to determining that that updated current value of the timing controller is within the threshold value of the initial baseline current value of the timing controller, updating the state of the indicator to indicate that the timing controller is nominal. Calibrating the system power profile of the information handling system further includes setting a power state one or more power rails of the information handling system to an off-power state; identifying, based on the off-power state of the power rails, a baseline current value for the information handling system, wherein identifying the initial baseline current value of the backlight power of a display device of the information handling system further comprises: setting the power state of a first power rail associated with the backlight power of the display device to an on-power state; and identifying, based on the on-power state of the first power rail and the baseline current value of the information handling system, the initial baseline current value of the backlight power of the display device of the information handling system. Identifying the initial baseline current value of the timing controller of the information handling system further includes setting the power state of the first power rail associated with the backlight power of the display device to an off-power state; setting the power state of a second power rail associated with the timing controller to an on-power state; and identifying, based on the on-power state of the second power rail and the baseline current value of the information handling system, the initial baseline current value of the timing controller of the information handling system. Calculating the updated system power profile further includes setting the power state one or more power rails of the information handling system to the off-power state; identifying, based on the off-power state of the power rails, an updated baseline current value for the information handling system, wherein identifying the updated baseline current value of the backlight power of the display device of the information handling system further includes setting the power state of the first power rail associated with the backlight power of the display device to an on-power state; and identifying, based on the on-power state of the first power rail and the updated baseline current value of the information handling system, the updated baseline current value of the backlight power of the display device of the information handling system. Identifying the updated baseline current value of the timing controller of the information handling system further includes setting the power state of the first power rail associated with the backlight power of the display device to an off-power state; setting the power state of the second power rail associated with the timing controller to the on-power state; and identifying, based on the on-power state of the second power rail and the updated baseline current value of the information handling system, the updated baseline current value of the timing controller of the information handling system. Identifying the initial baseline current value of the backlight power of the display device of the information handling system further includes setting a brightness parameter of the backlight power of the display device to a maximum value; in response to setting the brightness parameter: identifying a current value of a power supply unit providing power to the information handling system; determining a total number of brightness levels of the brightness parameter of the backlight power of the display for each change in value of the power supply unit; reducing the brightness parameter of the backlight power of the display by a first number of brightness levels to change the current value of the power supply unit to a lower value; and determining the initial baseline current value of the backlight power of the display device based on i) the total number of brightness levels of the brightness parameter of the backlight power of the display for each change in value of the power supply unit and ii) first number of brightness levels to change the current value of the power supply unit to the lower value. Determining the initial baseline current value of the backlight power of the display device is further based on i) the current value of the power supply unit.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

Figure 1:
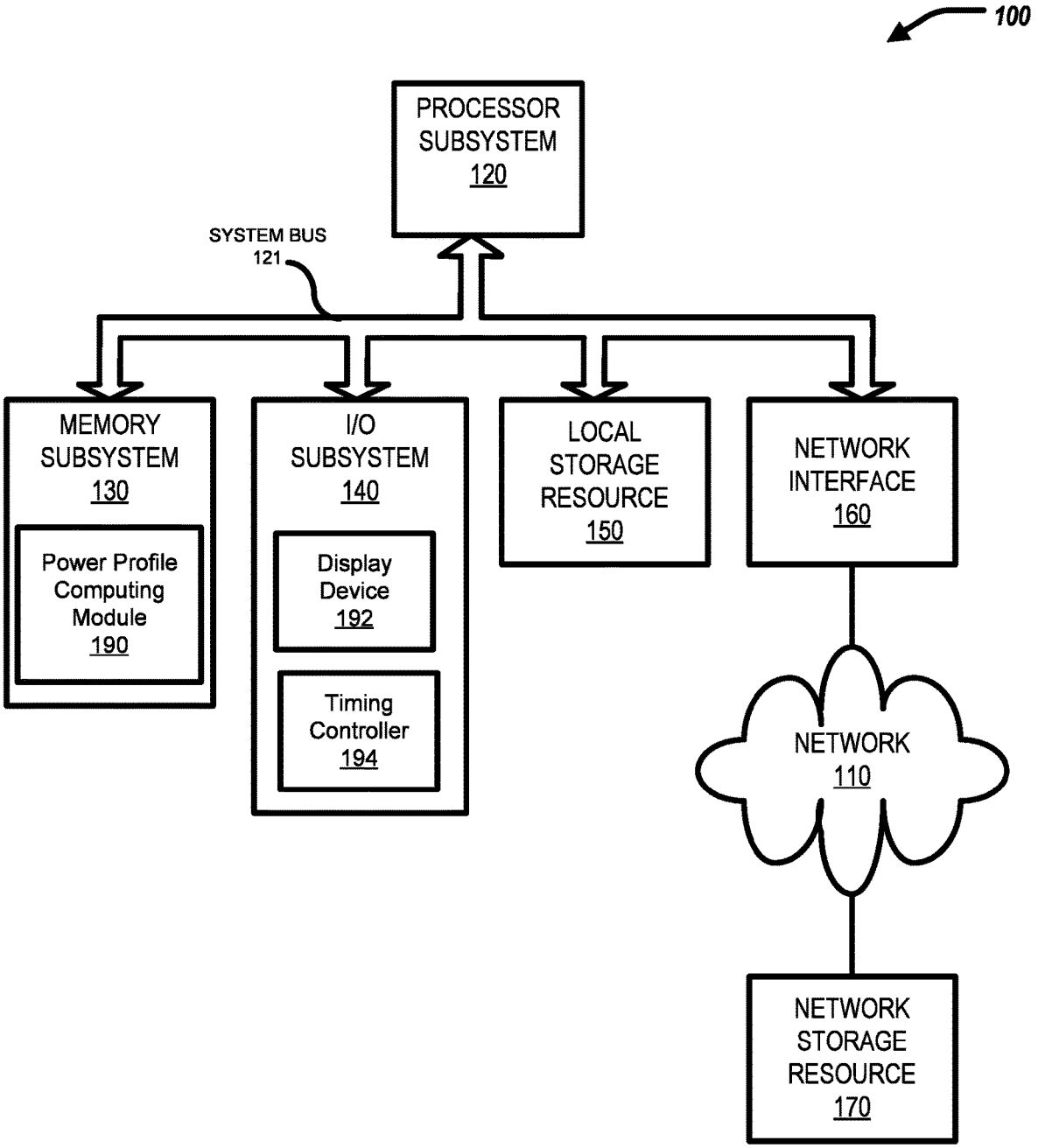
FIG. 1 is a block diagram of selected elements of an embodiment of an information handling system.

This disclosure discusses methods and systems for detecting display device failures using power consumption profiling. In short, a power profile computing can detect current draw changes triggered damage to a display device. The power profile computing module can detect current increases consistent with shorts in a timing controller and the display device caused by damage to the display device. The power profile computing module can detect current decreases associated with damage to the display device. The power profile computing module can store, upon initial boot of the information handling system, power parameters of the information handling system. The power profile computing module, when conducting a self-test of the information handling system and/or the display device, can compare the initial power parameters with updated power parameters (when the information handling system is being used by a user). The power profile computing module can detect non-functioning portions or damage to the display device based on such comparison.

Specifically, this disclosure discusses a system and a method for detecting failures using power consumption profiling, including calibrating, at a first time, a system power profile of an information handling system, including: identifying an initial baseline current value of a backlight power of a display device of the information handling system; identifying an initial baseline current value of a timing controller of the information handling system; calculating, at a second time, an updated system power profile, including: identifying an updated current value of the backlight power of the display device of the information handling system; identifying an updated current value of the timing controller of the information handling system; determining whether the updated current value of the backlight power of the display device is within a threshold value of the initial baseline current value of the backlight power of the display device; in response to determining that the updated current value of the backlight power of the display device is not within the threshold value of the initial baseline current value of the backlight power of the display device, determining whether the updated current value of the timing controller is within a threshold value of the initial baseline current value of the timing controller; and in response to determining that that updated current value of the timing controller is not within the threshold value of the initial baseline current value of the timing controller, updating a state of an indicator to indicate that the timing controller is damaged.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-7 wherein like numbers are used to indicate like and corresponding parts.

Turning now to the drawings, FIG. 1 illustrates a block diagram depicting selected elements of an information handling system 100 in accordance with some embodiments of the present disclosure. In various embodiments, information handling system 100 may represent different types of portable information handling systems, such as, display devices, head mounted displays, head mount display systems, smart phones, tablet computers, notebook computers, media players, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems. Components of information handling system 100 may include, but are not limited to, a processor subsystem 120, which may comprise one or more processors, and system bus 121 that communicatively couples various system components to processor subsystem 120 including, for example, a memory subsystem 130, an I/O subsystem 140, a local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130 and/or another component of information handling system). In the same or alternative embodiments, processor subsystem 120 may interpret and/or execute program instructions and/or process data stored remotely (e.g., in network storage resource 170).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. In various embodiments, I/O subsystem 140 may be used to support various peripheral devices, such as a touch panel, a display adapter, a keyboard, an accelerometer, a touch pad, a gyroscope, an IR sensor, a microphone, a sensor, or a camera, or another type of peripheral device. For example, the I/O subsystem 140 can further include a display device 192, and a timing controller 194.

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. Likewise, the network storage resource may comprise computer-readable media (e.g., hard disk drive, floppy disk drive, CD-ROM, and/or other type of rotating storage media, flash memory, EEPROM, and/or other type of solid state storage media) and may be generally operable to store instructions and/or data.

In FIG. 1, network interface 160 may be a suitable system, apparatus, or device operable to serve as an interface between information handling system 100 and a network 110. Network interface 160 may enable information handling system 100 to communicate over network 110 using a suitable transmission protocol and/or standard, including, but not limited to, transmission protocols and/or standards enumerated below with respect to the discussion of network 110. In some embodiments, network interface 160 may be communicatively coupled via network 110 to a network storage resource 170. Network 110 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 160 may enable wired and/or wireless communications (e.g., NFC or Bluetooth) to and/or from information handling system 100.

In particular embodiments, network 110 may include one or more routers for routing data between client information handling systems 100 and server information handling systems 100. A device (e.g., a client information handling system 100 or a server information handling system 100) on network 110 may be addressed by a corresponding network address including, for example, an Internet protocol (IP) address, an Internet name, a Windows Internet name service (WINS) name, a domain name or other system name. In particular embodiments, network 110 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, Ti, T3, Fiber Optics, Wi-Fi, or a mobile network connection including GSM, GPRS, 3G, or WiMax.

Network 110 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 110 and its various components may be implemented using hardware, software, or any combination thereof.

The information handling system 100 can also include a power profile computing module 190. The power profile computing module 190 can be included by the memory subsystem 130. The power profile computing module 190 can include a computer-executable program (software). The power profile computing module 190 can be executed by the processor subsystem 120.

In short, the power profile computing module 190 can detect current draw changes triggered damage to the display device 192. The power profile computing module 190 can detect current increases consistent with shorts in the timing controller 194 and the display device 192 caused by damage to the display device 192. The power profile computing module 190 can detect current decreases associated with damage to the display device 192. The power profile computing module 190 can store, upon initial boot of the information handling system 100, power parameters of the information handling system 100. The power profile computing module 190, when conducting a self-test of the information handling system 100 and/or the display device 192, can compare the initial power parameters with updated power parameters (when the information handling system 100 is being used by a user). The power profile computing module 190 can detect non-functioning portions or damage to the display device 192 based on such comparison.

Figure 2:
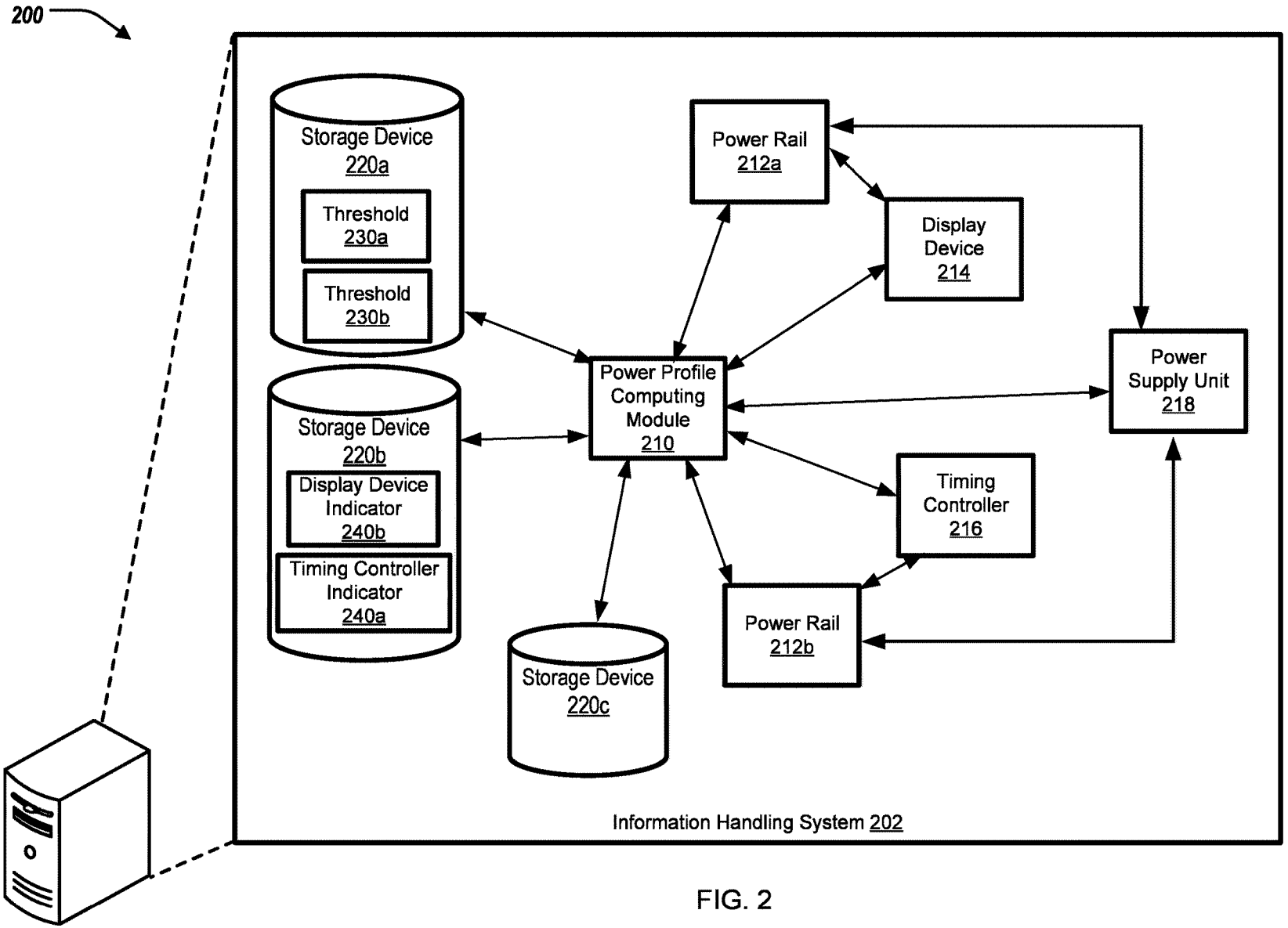
FIGS. 2, 7 illustrate respective block diagrams of an information handling system for detecting display device failures using power consumption profiling.

Turning to FIG. 2, FIG. 2 illustrates an environment 200 including an information handling system 202. The information handling system 202 can include a power profile computing module 210, a first power rail 212*a*, a second power rail 212*b*, a display device 214, a timing controller 216, a power supply unit (PSU) 218, a storage device 220*a*, a storage device 220*b*, and a storage device 220*c*. In some examples, the information handling system 202 is similar to, or includes, the information handling system 100 of FIG. 1. In some examples, the power profile computing module 210 is the same, or substantially the same, as the power profile computing module 190 of FIG. 1. In some examples, the display device 214 is the same, or substantially the same, as the display device 192 of FIG. 1. In some examples, the timing controller 216 is the same, or substantially the same, as the timing controller 190 of FIG. 1.

The power rails 212*a*, 212*b* can collectively be referred to as power rails 212. The storage device 220*a*, 220*b*, 220*c* can collectively be referred to as storage devices 220.

The information handling system 202 can include any number of power rails depending on the number and type of components requiring power.

The power profile computing module 210 can be in communication with the power rails 212, the display device 214, the timing controller 216, the power supply unit 218, and the storage devices 220. The power rail 212*a* can be in communication with (provide power to) the display device 214. The power rail 212*b* can be in communication with (provide power to) the timing controller 216. The power supply unit 218 can be in communication with (provide power to) the power rails 212.

To that end, the power profile computing module 210 can detect display device failures using power consumption profiling, described further herein. The power profile computing module 210 can calibrate, at a first time, a system power profile of the information handling system 202. For example, the first time can be shortly after manufacture (or during manufacture) of the information handling system 202.

Specifically, the power profile computing module 210 can set a power state of the power rails 212 to an off-power state. That is, the power profile computing module 210 can set the power rails 212 that are not providing power to the power profile computing module 210 to the off state. Further, the power profile computing module 210 can ensure that any other components/devices that are controllable by the power profile computing module 210 are held in reset such that power requirements of such are static.

The power profile computing module 210 can identify, based on the off-power state of the power rails 212, a baseline current value for the information handling system 202. That is, when the power rails 212 are in the off-power state, the power profile computing module 210 can identify a baseline current value of the information handling system 202. Specifically, the power supply unit 218 can include a current sensor to determine the current requirement of the information handling system 202 when the power rails 212 are in the off-power state (baseline current value). The power profile computing module 210 can obtain the baseline current value from the power supply unit 218. The power profile computing module 210 can store the baseline current value at the storage device 220*c*.

The power profile computing module 210 can identify an initial baseline current value of a backlight power of the display device 214. Specifically, the power profile computing module 210 can set the power state of the power rail 212*a* to an on-power state. Further, the power profile computing module 210 can set a brightness parameter of the backlight of the display device 214 to a maximum value. The power profile computing module 210 can identify, based on the on-power state of the power rail 212*a* and the baseline current value of the information handling system 202, the initial baseline current value of the backlight power of the display device 214. Specifically, the current sensor of the power supply unit 218 can determine the current requirement of the backlight power of the display device 214 when the power rail 212*a* is in the on-power state (initial baseline current value of the backlight power of the display device 214). The power profile computing module 210 can obtain the initial baseline current value of the backlight power of the display device 214 from the power supply unit 218. The power profile computing module 210 can store the initial baseline current value of the backlight power of the display device 214 at the storage device 220*c*.

The power profile computing module 210 can identify an initial baseline current value of the timing controller 216. Specifically, the power profile computing module 210 can set the power state of the power rail 212*a* to an off-power state. Further, the power profile computing module 210 can set the power state of the power rail 212*b* to an on-power state. The power profile computing module 210 can identify, based on the on-power state of the power rail 212*b* and the baseline current value of the information handling system 202, the initial baseline current value of the timing controller 216. Specifically, the current sensor of the power supply unit 218 can determine the current requirement of the timing controller 216 when the power rail 212*b* is in the on-power state (initial baseline current value of the timing controller 216). The power profile computing module 210 can obtain the initial baseline current value of the timing controller 216 from the power supply unit 218. The power profile computing module 210 can store the initial baseline current value of timing controller 216 at the storage device 220*c*.

Figure 3:
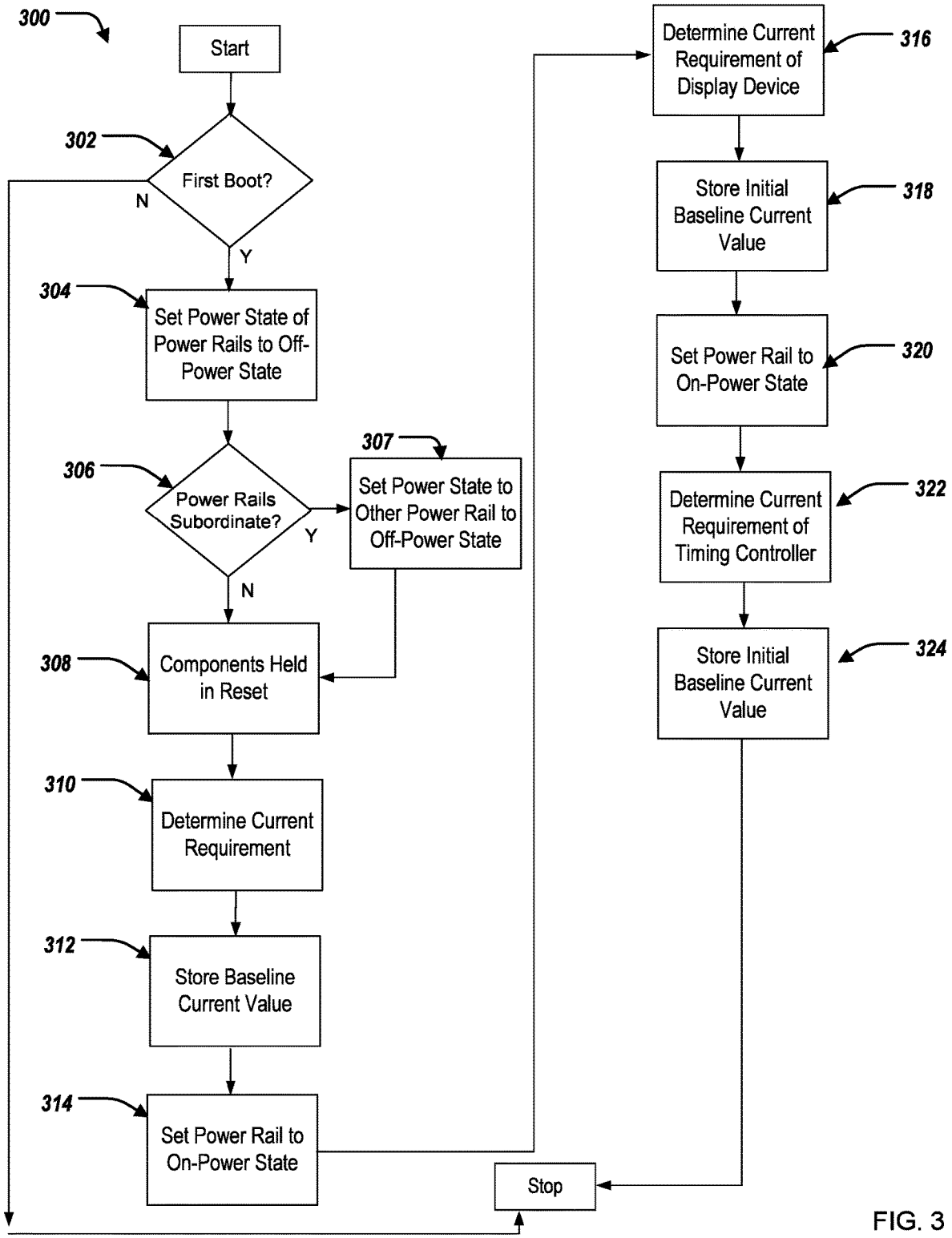
FIGS. 3-6 illustrates respective methods for detecting display device failures using power consumption profiling.

FIG. 3 illustrates a flowchart depicting selected elements of an embodiment of a method 300 for calibrating, at a first time, a system power profile of the information handling system 202. The method 300 may be performed by the information handling system 100, the information handling system 202 and/or the power profile computing module 210, and with reference to FIGS. 1-2. It is noted that certain operations described in method 300 may be optional or may be rearranged in different embodiments.

The power profile computing module 210 determines if the current boot of the information handling system 202 is a first (initial) boot of the information handling system, at 302. If the current boot of the information handling system 202 is not a first (initial) boot), the process 300 ends. If the current boot of the information handling system 202 is a first (initial) boot, the power profile computing module 210 sets the power state of the power rails 212 to an off-power state, at 304. The power profile computing module 210 determines whether either of the power rails 212 are subordinate to another power rail, at 306. If either of the power rails 212 are subordinate to another power rail, the power profile computing module 210 sets the power state of the another power rail to an off-power state, at 307. If both of the power rails 212 are not subordinate to another power rail, the power profile computing module 210 can ensure that any other components/device that are controllable by the power profile computing module 210 are held in reset such that power requirements of such are static, at 308.

The power profile computing module 210 can use the current sensor of the power supply unit 218 to determine the current requirement of the information handling system 202 when the power rails 212 are in the off-power state (baseline current value), at 310. The power profile computing module 210 can store the baseline current value at the storage device 220*c*, at 312.

The power profile computing module 210 can set the power state of the power rail 212*a* to an on-power state, and set a brightness parameter of the backlight of the display device 214 to a maximum value, at 314. The power profile computing module 210 can use the current sensor of the power supply unit 218 to determine the current requirement of the backlight power of the display device 214, at 316. The power profile computing module 210 can store the initial baseline current value of the backlight power of the display device 214 at the storage device 220*c*, at 318. The power profile computing module 210 can set the power state of the power rail 212*a* to an off-power state, and set the power state of the power rail 212*b* to an on-power state, at 320. The power profile computing module can use the current sensor of the power supply unit 218 to determine the current requirement of the timing controller 216, at 322. The power profile computing module 210 can store the initial baseline current value of timing controller 216 at the storage device 220*c*, at 324.

Returning back to FIG. 2, the power profile computing module 210 can calculate, at a second time (after the first time), an updated system power profile of the information handling system 202. For example, the second time (after the first time) can be when the information handling system 202 has been in possession by an end user of the information handling system 202.

Specifically, calculation of the updated system power profile of the information handling system 202 can include initiating a built-in self-test (BIST) boot flow of the display device 214 (e.g., a user of the information handling system 202 can initiate such by engaging respective keys of a keyboard input device of the information handling system 202). The power profile computing module 210 can then set the power state of the power rails 212 to the off-power state. That is, the power profile computing module 210 can set the power rails 212 that are not providing power to the power profile computing module 210 to the off state. Further, the power profile computing module 210 can ensure that any other components/device that are controllable by the power profile computing module 210 are held in reset such that power requirements of such are static.

The power profile computing module 210 can identify, based on the off-power state of the power rails 212, an updated baseline current value for the information handling system 202. That is, when the power rails 212 are in the off-power state, the power profile computing module 210 can identify an updated baseline current value of the information handling system 202. Specifically, the current sensor of the power supply unit 218 can determine the current requirement of the information handling system 202 when the power rails 212 are in the off-power state (updated baseline current value). The power profile computing module 210 can obtain the updated baseline current value from the power supply unit 218. The power profile computing module 210 can store the updated baseline current value at the storage device 220*c*.

The power profile computing module 210 can identify an updated current value of the backlight power of the display device 214. Specifically, the power profile computing module 210 can set the power state of the power rail 212*a* to an on-power state. Further, the power profile computing module 210 can set the brightness parameter of the backlight of the display device 214 to the maximum value. The power profile computing module 210 can identify, based on the on-power state of the power rail 212*a* and the updated baseline current value of the information handling system 202, the updated baseline current value of the backlight power of the display device 214. Specifically, the current sensor of the power supply unit 218 can determine the current requirement of the backlight power of the display device 214 when the power rail 212*a* is in the on-power state (updated baseline current value of the backlight power of the display device 214). The power profile computing module 210 can obtain the updated baseline current value of the backlight power of the display device 214 from the power supply unit 218. The power profile computing module 210 can store the updated baseline current value of the backlight power of the display device 214 at the storage device 220*c*.

The power profile computing module 210 can identify an updated baseline current value of the timing controller 216. Specifically, the power profile computing module 210 can set the power state of the power rail 212*a* to an off-power state. Further, the power profile computing module 210 can set the power state of the power rail 212*b* to an on-power state. The power profile computing module 210 can identify, based on the on-power state of the power rail 212*b* and the baseline current value of the information handling system 202, the updated baseline current value of the timing controller 216. Specifically, the current sensor of the power supply unit 218 can determine the current requirement of the timing controller 216 when the power rail 212*b* is in the on-power state (updated baseline current value of the timing controller 216). The power profile computing module 210 can obtain the updated baseline current value of the timing controller 216 from the power supply unit 218. The power profile computing module 210 can store the updated baseline current value of timing controller 216 at the storage device 220*c*.

The power profile computing module 210 can determine whether the updated current value of the backlight power of the display device 214 is within a threshold value 230*a* of the initial baseline current value of the backlight power of the display device 214. That is, the power profile computing module 210 can compare the updated current value of the backlight power of the display device 214 with the initial baseline current value of the backlight power of the display device 214. The power profile computing module 210 can obtain such values as stored by the storage device 220*c*. Further, based on such comparison, the power profile computing module 210 can obtain the threshold 230*a* from the storage device 220*a*, and determine whether such a difference is within the threshold 230*a*.

In some examples, in response to determining that the updated current value of the backlight power of the display device 214 is not within the threshold value 230*a* of the initial baseline current value of the backlight power of the display device 214, the power profile computing module 210 can determine whether the updated current value of the timing controller 216 is within a threshold value 230*b* of the initial baseline current value of the timing controller 216. That is, the power profile computing module 210 can compare the updated current value of the timing controller 216 with the initial baseline current value of the timing controller 216. The power profile computing module 210 can obtain such values as stored by the storage device 220*c*. Further, based on such comparison, the power profile computing module 210 can obtain the threshold 230*b* from the storage device 220*a*, and determine whether such a difference is within the threshold 230*b*.

In some examples, in response to determining that the updated current value of the timing controller 216 is not within the threshold value 230*b* of the initial baseline current value of the timing controller 216, the power profile computing module 210 can update a state of a timing controller indicator 240*a* to indicate that the timing controller 216 is damaged, or malfunctioning, or not nominal. The power profile computing module 210 can store the timing controller indicator 240*a* at the storage device 220*b*.

In some examples, in response to determining that the updated current value of the backlight power of the display device 214 is within the threshold value 230*a* of the initial baseline current value of the backlight power of the display device 214, the power profile computing module 210 can update a state of a display device indicator 240*b* to indicate that the display device 214 is nominal. The power profile computing module 210 can store the display device indicator 240*b* at the storage device 220*b*.

In some examples, in response to determining that the updated current value of the timing controller 216 is not within the threshold value 230*b* of the initial baseline current value of the timing controller 216, the power profile computing module 210 can update the state of the timing controller indicator 240*a* to indicate that the timing controller 216 is nominal. The power profile computing module 210 can store the timing controller indicator 240*a* at the storage device 220*b*.

Figure 4:
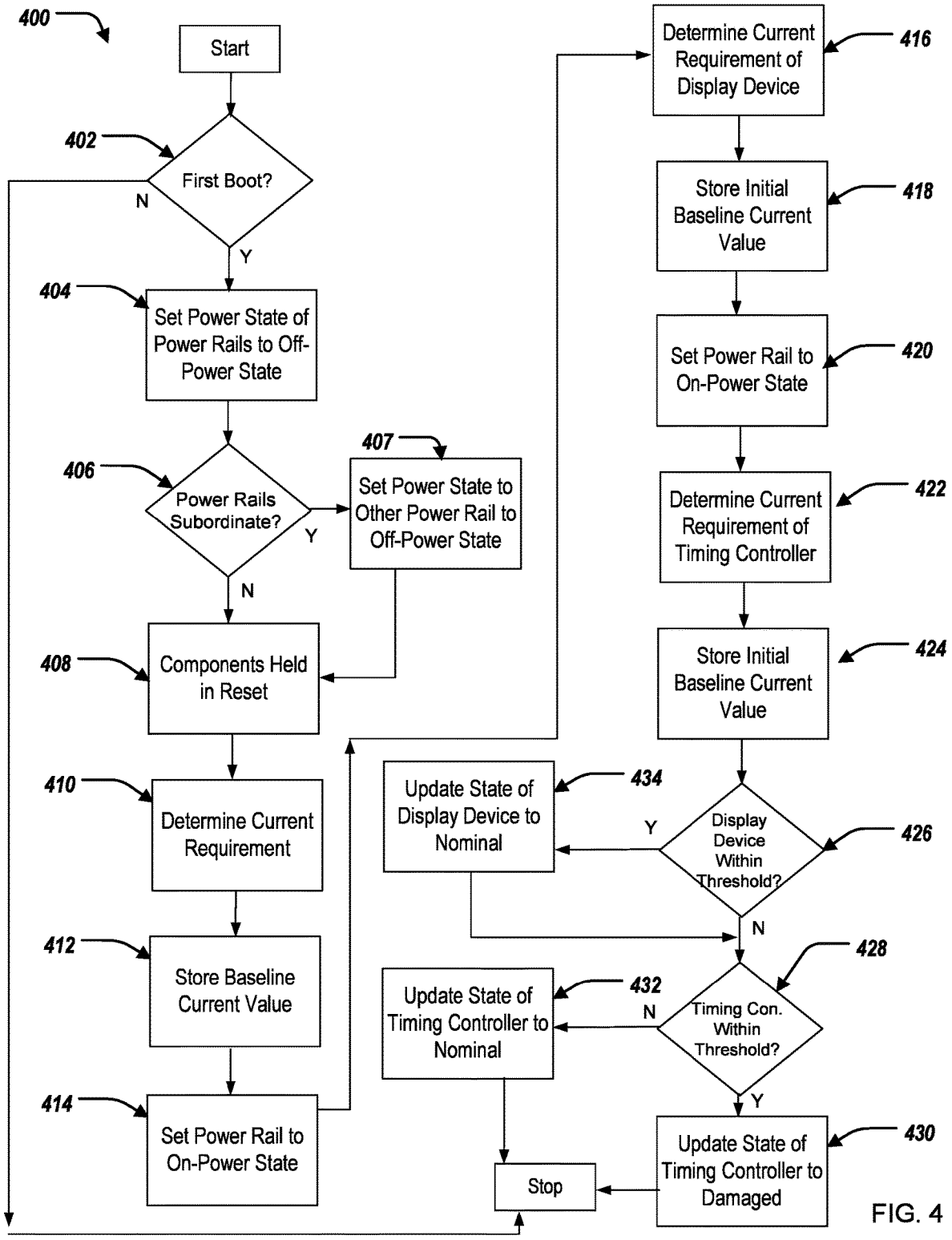

FIG. 4 illustrates a flowchart depicting selected elements of an embodiment of a method 400 for calculating, at a second time (after the first time), an updated system power profile of the information handling system 202. The method 400 may be performed by the information handling system 100, the information handling system 202 and/or the power profile computing module 210, and with reference to FIGS. 1-2. It is noted that certain operations described in method 400 may be optional or may be rearranged in different embodiments.

The power profile computing module 210 determines if the current boot of the information handling system 202 is a first (initial) boot of the information handling system, at 402. If the current boot of the information handling system 202 is not a first (initial) boot), the process 400 ends. If the current boot of the information handling system 202 is a first (initial) boot, the power profile computing module 210 sets the power state of the power rails 212 to an off-power state, at 404. The power profile computing module 210 determines whether either of the power rails 212 are subordinate to another power rail, at 406. If either of the power rails 212 are subordinate to another power rail, the power profile computing module 210 sets the power state of the another power rail to an off-power state, at 407. If both of the power rails 212 are not subordinate to another power rail, the power profile computing module 210 can ensure that any other components/device that are controllable by the power profile computing module 210 are held in reset such that power requirements of such are static, at 408.

The power profile computing module 210 can use the current sensor of the power supply unit 218 to determine the current requirement of the information handling system 202 when the power rails 212 are in the off-power state (updated baseline current value), at 410. The power profile computing module 210 can store the baseline current value at the storage device 220*c*, at 412.

The power profile computing module 210 can set the power state of the power rail 212*a* to an on-power state, and set a brightness parameter of the backlight of the display device 214 to a maximum value, at 414. The power profile computing module 210 can use the current sensor of the power supply unit 218 to determine the current requirement of the backlight power of the display device 214, at 416. The power profile computing module 210 can store the updated baseline current value of the backlight power of the display device 214 at the storage device 220*c*, at 418. The power profile computing module 210 can set the power state of the power rail 212*a* to an off-power state, and set the power state of the power rail 212*b* to an on-power state, at 420. The power profile computing module can use the current sensor of the power supply unit 218 to determine the current requirement of the timing controller 216, at 422. The power profile computing module 210 can store the updated baseline current value of timing controller 216 at the storage device 220*c*, at 424.

The power profile computing module 210 can determine whether the updated current value of the backlight power of the display device 214 is within the threshold value 230*a* of the initial baseline current value of the backlight power of the display device 214, at 426. In response to determining that the updated current value of the backlight power of the display device 214 is not within the threshold value 230*a* of the initial baseline current value of the backlight power of the display device 214, the power profile computing module 210 can determine whether the updated current value of the timing controller 216 is within a threshold value 230*b* of the initial baseline current value of the timing controller 216, at 428. In response to determining that the updated current value of the timing controller 216 is not within the threshold value 230*b* of the initial baseline current value of the timing controller 216, the power profile computing module 210 can update a state of the timing controller indicator 240*a* to indicate that the timing controller 216 is damaged, or malfunctioning, or not nominal, at 430. In response to determining that the updated current value of the timing controller 216 is not within the threshold value 230*b* of the initial baseline current value of the timing controller 216, the power profile computing module 210 can update the state of the timing controller indicator 240*a* to indicate that the timing controller 216 is nominal, at 432. In response to determining that the updated current value of the backlight power of the display device 214 is within the threshold value 230*a* of the initial baseline current value of the backlight power of the display device 214, the power profile computing module 210 can update a state of a display device indicator 240*b* to indicate that the display device 214 is nominal, at 434. The process can proceed to step 428.

In some examples, if the power supply unit 218 (and current sensor) are too insensitive to measure subtle current changes (associated with small failures at the display device 214), the brightness of the backlight power of the display device 214 can be modified to simulate an order of magnitude (e.g., 10 times) better current resolution.

Specifically, as previously mentioned, the power profile computing module 210 can identify the initial baseline current value of the backlight power of the display device 214. In particular, the power profile computing module 210 can set the brightness parameter of the backlight power of the display device 214 to a maximum value. In response, the power profile computing module 210 can identify the current value of the power supply unit 218. The power profile computing module 210 can store this value at the storage device 220*c*. The power profile computing module 210 can determine a total number of brightness levels of the brightness parameter of the backlight power of the display 214 for each change in value of the power supply unit 218. In other words, to simulate a more sensitive sensor on the power supply unit 218, the power profile computing module 210 can calibrate the number of backlight brightness values can occur without changing a digital value returned by the power supply unit 218.

For example, the power supply unit 218 can provide a value of 9 for brightness values 240-249 of the display device 214, a value of 8 for a brightness value of 239, and a value of 10 for a brightness value of 250. During testing (e.g., during the second time), the power supply unit can return a value of 5, the power profile computing module 210 can reduce the brightness levels at the display device 214 until the power supply unit 218 returns a value of 4.

Figure 5:
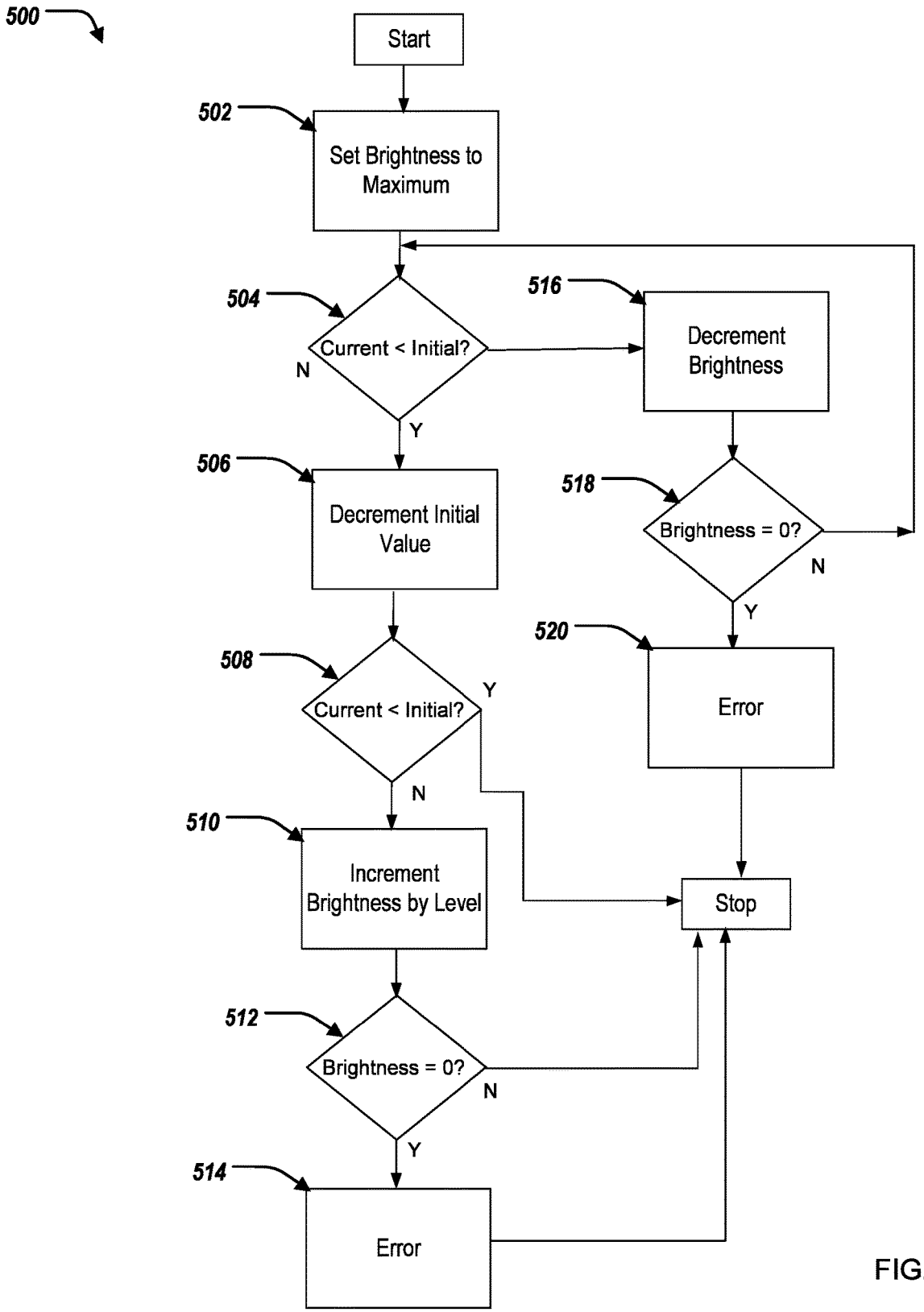

FIG. 5 illustrates a flowchart depicting selected elements of an embodiment of a method 500 for identifying the initial baseline current value of the backlight power of the display device 214. The method 500 may be performed by the information handling system 100, the information handling system 202 and/or the power profile computing module 210, and with reference to FIGS. 1-2. It is noted that certain operations described in method 500 may be optional or may be rearranged in different embodiments.

The power profile computing module 210 can set the brightness parameter of the backlight power of the display device 214 to a maximum value, at 502. The power profile computing module 210 determines if the current value at the power supply unit 218 is less than an initial value at the power supply unit 218, at 504. If the current value at the power supply 218 is less than the initial value at the power supply unit 218, the power profile computing module 210 decrements the initial value at the power supply unit 218 by 1, at 506.

The power profile computing module 210 determines if the current value at the power supply unit 218 is less than the decremented initial value at the power supply unit 218, at 508. When the current value at the power supply unit 218 is not less than the decremented initial value at the power supply unit 218, the process ends. When the current value at the power supply unit 218 is less than the decremented initial value at the power supply unit 218, the power profile computing module 210 can increment the brightness values per by level returned by the power supply unit 218 by 1 (change in value of the power supply unit 218) and decrement the brightness of the display device 214 by 1, at 510. The power profile computing module 210 can determine if the brightness parameter of the display device 214 is equal to 0, at 512. When the brightness parameter of the display device 214 is equal to 0, the power profile computing module 210 can generate an error, at 514. When the brightness parameter of the display device 214 is not equal to 0, the process ends.

If the current value at the power supply 218 is not less than the initial value at the power supply unit 218 (at 504), the power profile computing module 210 decrements the brightness of the display device 214 by 1, at 516. The power profile computing module 210 can determine if the brightness parameter of the display device 214 is equal to 0, at 518. When the brightness parameter of the display device 214 is equal to 0, the power profile computing module 210 can generate an error, at 520. When the brightness parameter of the display device 214 is not equal to 0, the method proceeds to step 504.

Referring back to FIG. 2, in furtherance of identifying the initial baseline current value of the backlight power of the display device 214, the power profile computing module 210 reduces the brightness parameter of the backlight power of the display device 214 by a number of brightness levels to change the current value of the power supply unit 218 to a lower value. In other words, the power profile computing module 210 can determine how many values the brightness parameter of the display device 214 can be reduced before the digital value retuned by the power supply unit 218 is reduced. The power profile computing module 210 can determine that the initial baseline current of the backlight power of the display device 214 based on i) the total number of brightness of the brightness parameter of the backlight power of the display device 214 for each change in value of the power supply unit 218 ii) the number of brightness levels to change the current value of the power supply unit 218 to the lower value, and iii) the current value of the power supply unit 218. In other words, the power profile computing module 210 can determine how many values the brightness of the display device 214 can be reduced prior to the digital value returned by the charger is reduced.

In some examples, the power profile computing module 210 can find a ratio (divide) of the i) total number of brightness of the brightness parameter of the backlight power of the display device 214 for each change in value of the power supply unit 218 to ii) the number of brightness levels to change the current value of the power supply unit 218 to the lower value. The power profile computing module 210 can add such ratio to the current value of the power supply unit 218, and store such as the initial baseline current value of the backlight power of the display device 214.

Continuing the example above, if the brightness value was reduced 3 times to change the value at the power supply unit 218 from 5 to 4, and there are 10 brightness levels for each change in value of the power supply unit 218, then the power profile computing module 210 can determine that the baseline current value of the backlight power of the display device 214 is 3/10 or 5.3.

In some examples, in furtherance of identifying the updated baseline current value of the backlight power of the display device 214, the power profile computing module 210 reduces the brightness parameter of the backlight power of the display device 214 by a number of brightness levels to change the current value of the power supply unit 218 to a lower value. In other words, the power profile computing module 210 can determine how many values the brightness parameter of the display device 214 can be reduced before the digital value retuned by the power supply unit 218 is reduced. The power profile computing module 210 can determine that the updated baseline current of the backlight power of the display device 214 based on i) the total number of brightness of the brightness parameter of the backlight power of the display device 214 for each change in value of the power supply unit 218 ii) the number of brightness levels to change the current value of the power supply unit 218 to the lower value, and iii) the current value of the power supply unit 218. In other words, the power profile computing module 210 can determine how many values the brightness of the display device 214 can be reduced prior to the digital value returned by the charger is reduced.

Figure 6:
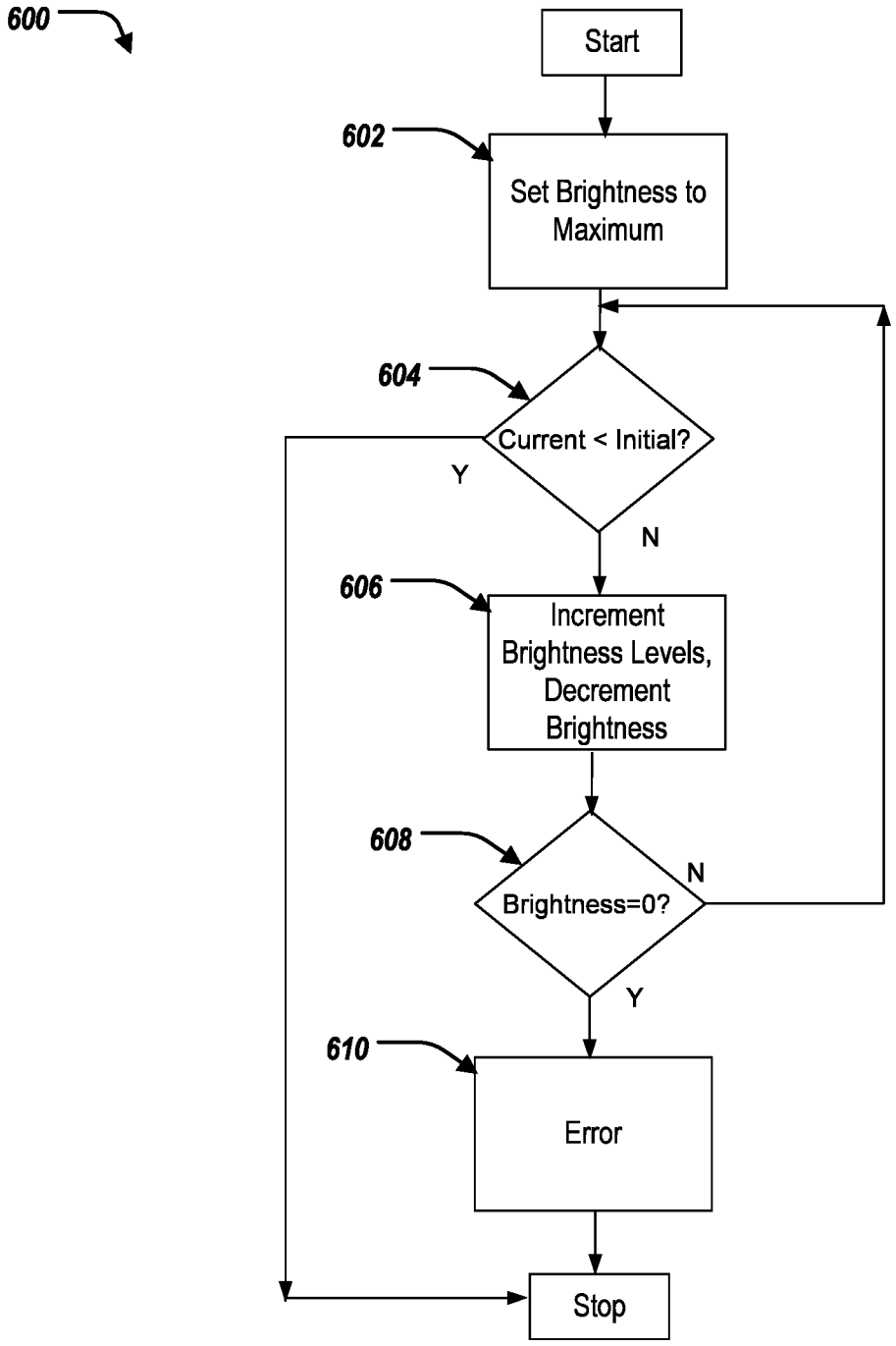

FIG. 6 illustrates a flowchart depicting selected elements of an embodiment of a method 600 for identifying the initial baseline current value of the backlight power of the display device 214. The method 600 may be performed by the information handling system 100, the information handling system 202 and/or the power profile computing module 210, and with reference to FIGS. 1-2. It is noted that certain operations described in method 600 may be optional or may be rearranged in different embodiments.

The power profile computing module 210 can set the brightness parameter of the backlight power of the display device 214 to a maximum value, at 602. The power profile computing module 210 determines if the current value at the power supply unit 218 is less than an initial value at the power supply unit 218, at 604. When the current value at the power supply unit 218 is less than the initial value at the power supply unit 218, the power profile computing module 210 can increment the number of brightness levels to change the current value of the power supply unit 218 to the lower value by 1 and decrement the brightness of the display device 214 by 1, at 606. The power profile computing module 210 can determine if the brightness parameter of the display device 214 is equal to 0, at 608. When the brightness parameter of the display device 214 is equal to 0, the power profile computing module 210 can generate an error, at 610. When the brightness parameter of the display device 214 is not equal to 0 at step 608, the method proceed to step 604. When the current value at the power supply unit 218 is not less than the initial value at the power supply unit 218 at step 604, the process ends.

Figure 7:
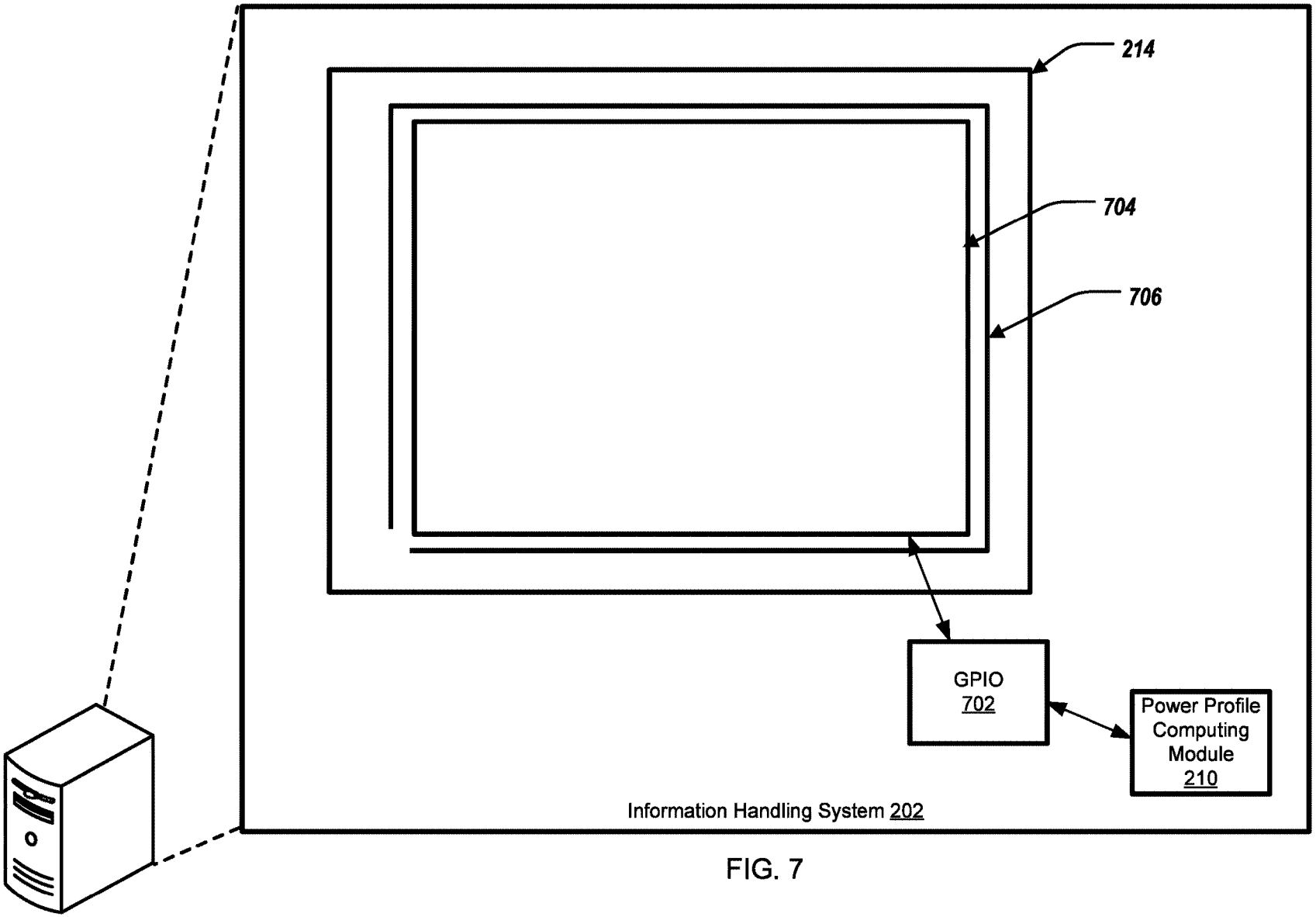

FIG. 7 illustrates a further implementation of the information handling system 202. Specifically, the display device 214 can include a glass surface 704 (or glass panel 704). A conductive surface 706 can surround the glass surface 704. For example, the conductive surface 706 can include a highly conductive material (such as silver ink). In some examples, the conductive surface 706 is not an elastomer. The conductive surface 706 can be in communication with a general purpose input/output (GPIO) pin 702. The power profile computing module can be in communication with the GPIO 702.

To that end, a crack/break in the glass surface 704 can result in a break in the continuity of the conductive surface 706. Further, the GPIO 702 can detect such a break in the continuity of the glass surface 704. The power profile computing module 210 can receive a signal from the GPIO 702 indicating such, and take appropriate action, including updating the indicators 240*a*, 240*b* stored by the storage device 220 as appropriate.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A computer-implemented method of detecting failures using power consumption profiling, the method comprising:

calibrating, at a first time, a system power profile of an information handling system, including:

identifying an initial baseline current value of a backlight power of a display device of the information handling system;

identifying an initial baseline current value of a timing controller of the information handling system;

calculating, at a second time, an updated system power profile, including:

identifying an updated current value of the backlight power of the display device of the information handling system;

identifying an updated current value of the timing controller of the information handling system;

determining whether the updated current value of the backlight power of the display device is within a threshold value of the initial baseline current value of the backlight power of the display device;

in response to determining that the updated current value of the backlight power of the display device is not within the threshold value of the initial baseline current value of the backlight power of the display device, determining whether the updated current value of the timing controller is within a threshold value of the initial baseline current value of the timing controller; and in response to determining that the updated current value of the timing controller is not within the threshold value of the initial baseline current value of the timing controller, updating a state of an indicator to indicate that the timing controller is damaged.

2. The computer-implemented method of claim 1, further comprising:

in response to determining that the updated current value of the backlight power of the display device is within the threshold value of the initial baseline current value of the backlight power of the display device, updating a state of an additional indicator to indicate indicator that the display device is nominal.

3. The computer-implemented method of claim 1, further comprising:

in response to determining that the updated current value of the timing controller is within the threshold value of the initial baseline current value of the timing controller, updating the state of the indicator to indicate that the timing controller is nominal.

4. The computer-implemented method of claim 1, wherein calibrating the system power profile of the information handling system further comprises:

setting a power state one or more power rails of the information handling system to an off-power state;

identifying, based on the off-power state of the power rails, a baseline current value for the information handling system, wherein identifying the initial baseline current value of the backlight power of a display device of the information handling system further comprises:

setting the power state of a first power rail associated with the backlight power of the display device to an on-power state; and identifying, based on the on-power state of the first power rail and the baseline current value of the information handling system, the initial baseline current value of the backlight power of the display device of the information handling system.

5. The computer-implemented method of claim 4, wherein identifying the initial baseline current value of the timing controller of the information handling system further comprises:

setting the power state of the first power rail associated with the backlight power of the display device to an off-power state;

setting the power state of a second power rail associated with the timing controller to an on-power state; and identifying, based on the on-power state of the second power rail and the baseline current value of the information handling system, the initial baseline current value of the timing controller of the information handling system.

6. The computer-implemented method of claim 5, wherein calculating the updated system power profile further comprises:

setting the power state one or more power rails of the information handling system to the off-power state;

identifying, based on the off-power state of the power rails, an updated baseline current value for the information handling system, wherein identifying the updated baseline current value of the backlight power of the display device of the information handling system further comprises:

setting the power state of the first power rail associated with the backlight power of the display device to an on-power state; and identifying, based on the on-power state of the first power rail and the updated baseline current value of the information handling system, the updated baseline current value of the backlight power of the display device of the information handling system.

7. The computer-implemented method of claim 6, wherein identifying the updated baseline current value of the timing controller of the information handling system further comprises:

setting the power state of the first power rail associated with the backlight power of the display device to an off-power state;

setting the power state of the second power rail associated with the timing controller to the on-power state; and identifying, based on the on-power state of the second power rail and the updated baseline current value of the information handling system, the updated baseline current value of the timing controller of the information handling system.

8. The computer-implemented method of claim 1, wherein identifying the initial baseline current value of the backlight power of the display device of the information handling system further comprises:

setting a brightness parameter of the backlight power of the display device to a maximum value;

in response to setting the brightness parameter:

identifying a current value of a power supply unit providing power to the information handling system;

determining a total number of brightness levels of the brightness parameter of the backlight power of the display for each change in value of the power supply unit;

reducing the brightness parameter of the backlight power of the display by a first number of brightness levels to change the current value of the power supply unit to a lower value; and determining the initial baseline current value of the backlight power of the display device based on i) the total number of brightness levels of the brightness parameter of the backlight power of the display for each change in value of the power supply unit and ii) first number of brightness levels to change the current value of the power supply unit to the lower value.

9. The computer-implemented method of claim 1, wherein determining the initial baseline current value of the backlight power of the display device is further based on i) the current value of the power supply unit.

10. An information handling system comprising:

a display device;

a timing controller;

a processor having access to memory media storing instructions executable by the processor to perform operations comprising, comprising:

calibrating, at a first time, a system power profile of the information handling system, including:

identifying an initial baseline current value of a backlight power of the display device of the information handling system;

identifying an initial baseline current value of the timing controller of the information handling system;

calculating, at a second time, an updated system power profile, including:

identifying an updated current value of the backlight power of the display device of the information handling system;

identifying an updated current value of the timing controller of the information handling system;

determining whether the updated current value of the backlight power of the display device is within a threshold value of the initial baseline current value of the backlight power of the display device;

in response to determining that the updated current value of the backlight power of the display device is not within the threshold value of the initial baseline current value of the backlight power of the display device, determining whether the updated current value of the timing controller is within a threshold value of the initial baseline current value of the timing controller; and in response to determining that the updated current value of the timing controller is not within the threshold value of the initial baseline current value of the timing controller, updating a state of an indicator to indicate that the timing controller is damaged.

11. The information handling system of claim 10, the operations further comprising:

in response to determining that the updated current value of the backlight power of the display device is within the threshold value of the initial baseline current value of the backlight power of the display device, updating a state of an additional indicator to indicate that the display device is nominal.

12. The information handling system of claim 10, the operations further comprising:

in response to determining that the updated current value of the timing controller is within the threshold value of the initial baseline current value of the timing controller, updating the state of the indicator to indicate that the timing controller is nominal.

13. The information handling system of claim 10, wherein calibrating the system power profile of the information handling system further comprises:

setting a power state one or more power rails of the information handling system to an off-power state;

identifying, based on the off-power state of the power rails, a baseline current value for the information handling system, wherein identifying the initial baseline current value of the backlight power of a display device of the information handling system further comprises:

setting the power state of a first power rail associated with the backlight power of the display device to an on-power state; and identifying, based on the on-power state of the first power rail and the baseline current value of the information handling system, the initial baseline current value of the backlight power of the display device of the information handling system.

14. The information handling system of claim 13, wherein identifying the initial baseline current value of the timing controller of the information handling system further comprises:

setting the power state of the first power rail associated with the backlight power of the display device to an off-power state;

setting the power state of a second power rail associated with the timing controller to an on-power state; and identifying, based on the on-power state of the second power rail and the baseline current value of the information handling system, the initial baseline current value of the timing controller of the information handling system.

15. The information handling system of claim 14, wherein calculating the updated system power profile further comprises:

setting the power state one or more power rails of the information handling system to the off-power state;

identifying, based on the off-power state of the power rails, an updated baseline current value for the information handling system, wherein identifying the updated baseline current value of the backlight power of the display device of the information handling system further comprises:

setting the power state of the first power rail associated with the backlight power of the display device to an on-power state; and identifying, based on the on-power state of the first power rail and the updated baseline current value of the information handling system, the updated baseline current value of the backlight power of the display device of the information handling system.

16. The information handling system of claim 15, wherein identifying the updated baseline current value of the timing controller of the information handling system further comprises:

setting the power state of the first power rail associated with the backlight power of the display device to an off-power state;

setting the power state of the second power rail associated with the timing controller to the on-power state; and identifying, based on the on-power state of the second power rail and the updated baseline current value of the information handling system, the updated baseline current value of the timing controller of the information handling system.

17. The information handling system of claim 10, wherein identifying the initial baseline current value of the backlight power of the display device of the information handling system further comprises:

setting a brightness parameter of the backlight power of the display device to a maximum value;

in response to setting the brightness parameter:

identifying a current value of a power supply unit providing power to the information handling system;

determining a total number of brightness levels of the brightness parameter of the backlight power of the display for each change in value of the power supply unit;

reducing the brightness parameter of the backlight power of the display by a first number of brightness levels to change the current value of the power supply unit to a lower value; and determining the initial baseline current value of the backlight power of the display device based on i) the total number of brightness levels of the brightness parameter of the backlight power of the display for each change in value of the power supply unit and ii)

first number of brightness levels to change the current value of the power supply unit to the lower value.

18. The information handling system of claim 10, wherein determining the initial baseline current value of the backlight power of the display device is further based on i) the current value of the power supply unit.

19. A non-transitory computer-readable medium storing software comprising instructions executable by one or more computers which, upon such execution, cause the one or more computers to perform operations comprising:

calibrating, at a first time, a system power profile of an information handling system, including:

identifying an initial baseline current value of a backlight power of a display device of the information handling system;

identifying an initial baseline current value of a timing controller of the information handling system;

calculating, at a second time, an updated system power profile, including:

identifying an updated current value of the backlight power of the display device of the information handling system;

identifying an updated current value of the timing controller of the information handling system;

determining whether the updated current value of the backlight power of the display device is within a threshold value of the initial baseline current value of the backlight power of the display device;

in response to determining that the updated current value of the backlight power of the display device is not within the threshold value of the initial baseline current value of the backlight power of the display device, determining whether the updated current value of the timing controller is within a threshold value of the initial baseline current value of the timing controller; and in response to determining that the updated current value of the timing controller is not within the threshold value of the initial baseline current value of the timing controller, updating a state of an indicator to indicate that the timing controller is damaged.

20. The non-transitory computer-readable medium of claim 19, the operations further comprising:

in response to determining that the updated current value of the backlight power of the display device is within the threshold value of the initial baseline current value of the backlight power of the display device, updating a state of an additional indicator to indicate that the display device is nominal.

* * * * *